US007090228B2

(12) United States Patent
Reynolds

(10) Patent No.: US 7,090,228 B2
(45) Date of Patent: Aug. 15, 2006

(54) SNOWBOARD BINDING ROTATIONAL SYSTEM WITH STANCE ADJUSTMENT

(76) Inventor: Dwight H. Reynolds, 1515 Regent St., Suite 3, Redwood City, CA (US) 94061

( * ) Notice: Subject to any disclaimer, the term of this patent is extended or adjusted under 35 U.S.C. 154(b) by 0 days.

(21) Appl. No.: 11/255,731

(22) Filed: Oct. 21, 2005

(65) Prior Publication Data

US 2006/0087090 A1 Apr. 27, 2006

Related U.S. Application Data

(60) Provisional application No. 60/620,947, filed on Oct. 21, 2004.

(51) Int. Cl.
*A63C 9/00* (2006.01)

(52) U.S. Cl. ..... 280/14.24; 280/14.21

(58) Field of Classification Search ..... 280/14.24, 280/14.21, 14.22, 617, 618, 607, 633, 634
See application file for complete search history.

(56) References Cited

U.S. PATENT DOCUMENTS 5,820,155 A * 10/1998 Brisco ..... 280/607
5,947,488 A * 9/1999 Gorza et al. ..... 280/14.21
6,062,584 A * 5/2000 Sabol ..... 280/607
6,155,578 A * 12/2000 Patterson ..... 280/14.24
6,203,051 B1 * 3/2001 Sabol ..... 280/607
6,450,511 B1 * 9/2002 LaVoy ..... 280/14.22
6,520,531 B1 * 2/2003 Gien ..... 280/618
6,575,489 B1 * 6/2003 White ..... 280/613
6,994,370 B1 * 2/2006 Sabol ..... 280/618
2003/0011171 A1 * 1/2003 Battistella ..... 280/618
2003/0038455 A1 * 2/2003 Lett ..... 280/618
2003/0047913 A1 * 3/2003 Holzer et al. ..... 280/617
2003/0178812 A1 * 9/2003 Schaller et al. ..... 280/618
2003/0184031 A1 * 10/2003 Feurer et al. ..... 280/14.24
2003/0230870 A1 * 12/2003 Sabol ..... 280/618
2004/0188983 A1 * 9/2004 Scholten ..... 280/618
2005/0051978 A1 * 3/2005 Sabol ..... 280/14.24
2005/0093257 A1 * 5/2005 Holzer et al. ..... 280/14.24
2005/0248129 A1 * 11/2005 Pelchat ..... 280/629

* cited by examiner

*Primary Examiner*—J. Allen Shriver
(74) *Attorney, Agent, or Firm*—Quarles & Brady LLP

(57) ABSTRACT

A snowboard boot binding rotation system provides for detent notches that may be adjusted in rotational separation by the relative rotation of two co-rotating disks. Adjustment of the location of the lock engaging these notches and adjustment in the separation between the notches allows complete adjustment of the user's stance for snowboarding and skateboarding. A pawl mechanism allows for a hard-lock and soft-lock to be used in the snowboarding stance and skateboarding stance, respectively, for convenience of use by not requiring the boot to be removed from the binding to make the stance angle adjustments.

15 Claims, 4 Drawing Sheets

FIG. 4
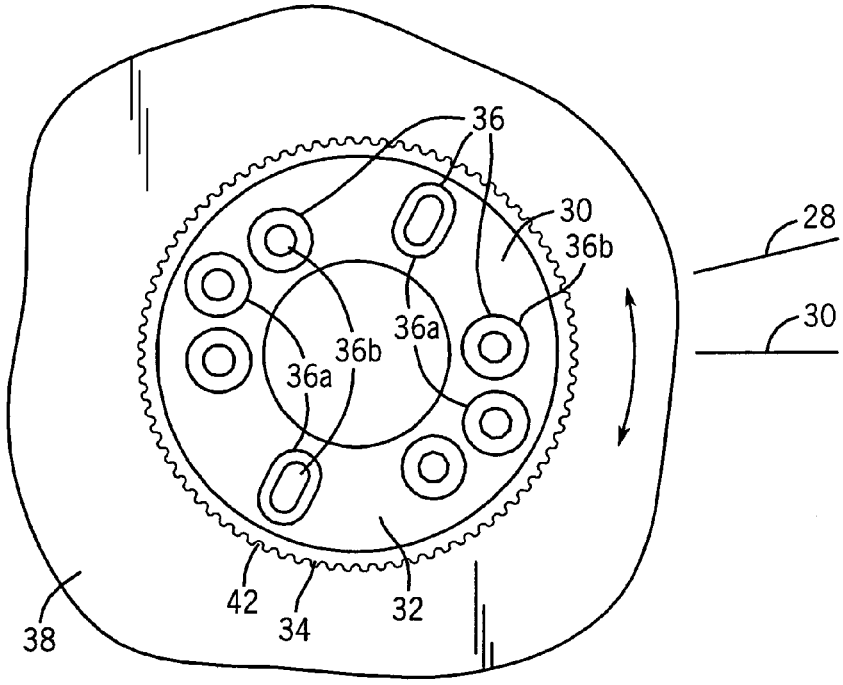
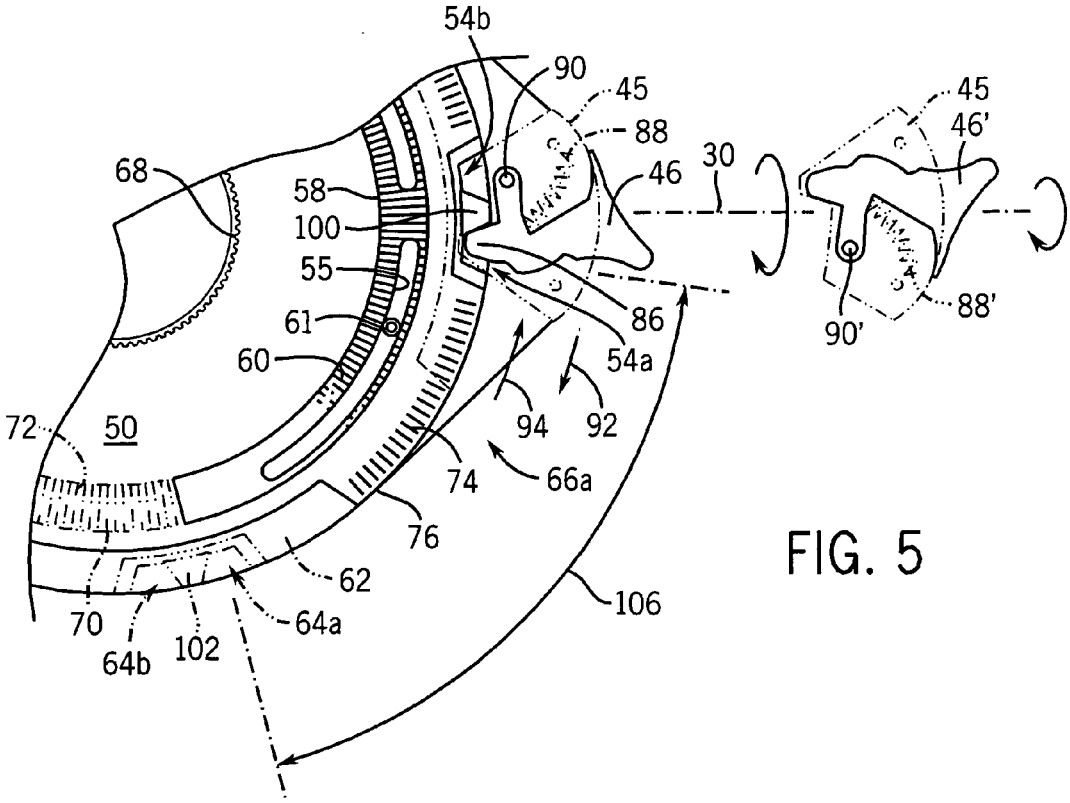
FIG. 5

SNOWBOARD BINDING ROTATIONAL SYSTEM WITH STANCE ADJUSTMENT

CROSS-REFERENCE TO RELATED APPLICATIONS

This application claims the benefit of U.S. Provisional Application 60/620,947 filed Oct. 21, 2004 hereby incorporated by reference.

STATEMENT REGARDING FEDERALLY SPONSORED RESEARCH OR DEVELOPMENT

BACKGROUND OF THE INVENTION

The invention relates generally to snowboard boot binding systems, and specifically to a binding system allowing the foot to be easily rotated between a snowboarding and skateboarding position preset to any of a variety of stance angles.

Traditional skis are designed so that each foot of the skier, within its own boot, is firmly fastened to a ski oriented along the center line of the ski.

Unlike skis, a snowboard is used by fastening both feet attached through boots fitting within boot bindings to a single board. The snowboard is ridden in a standing position facing sideways with the feet positioned transversely across the snowboard. One foot is fixed near the front of the board (nose) and the other fixed near the back of the board (tail).

A number of different binding systems exist for holding the user's booted feet in position on the board. Generally, these bindings can be attached to the board at different angles to allow the user to adjust the angle or stance that the user prefers for snowboarding. When the user is not snowboarding, but when moving on level areas, for example, through chair lift lines, the customary practice is for the snowboarder to remove his or her back foot from its binding leaving a front foot fixed to the binding in transverse position pushing with the free foot in a scooter-type fashion. This mode of movement will be called "skateboarding" to distinguish it from "snowboarding" in which the user is gliding under the force of gravity down a slope. During skateboarding, the angle of the front binding places the user's foot at an awkward angle that may be uncomfortable or promote injury.

U.S. Pat. No. 6,102,430 issued Aug. 15, 2000, hereby incorporated by reference and assigned to the same assignee as the present invention, describes a snowboard boot binding that allows the user to quickly shift his or her foot between a snowboarding angle and a skateboarding angle. This particular invention provides two detent positions, one providing a "hard-lock" for use while snowboarding, which requires manual activation of a lock lever, and the other providing a "soft-lock" for use while skateboarding, that does not require manual activation of a lock lever, but allows the binding to be moved by applying force on the binding by the user's foot. In this invention, the user's foot is held securely for downhill snowboarding, can be released for skateboarding by movement of the lever, and then quickly returned to the snowboarding position by applying appropriate force to the binding.

While this system provides a simple and intuitive, rapid shifting between skateboarding and snowboarding modes, the predetermined hard-lock and soft-lock detent positions provide a fixed angular separation that may not be right for every user. While the angle of the binding as mounted on the snowboard may be readily changed during installation, it is not conveniently adjustable, for example, on the slope.

One possible solution to this problem is to provide for a large number of detent positions so that the rotation of the binding is essentially continuous and adjustable on the slope. This approach, however, has a significant disadvantage in that multiple detent positions make it difficult to flexibly implement a hard and soft detent. Further, multiple detents require that the snowboarder carefully select the appropriate detent position each time the snowboard mode is changed significantly reducing the convenience and fluidity with which the binding may be used. Carelessness in selecting among multiple detents may undesirably change the user's stance angle between snowboarding runs.

SUMMARY OF THE INVENTION

The present invention provides a rotating binding that allows customizable adjustment of the angle between the hard and soft detent positions with the convenience described above. Generally, this adjustability is provided by use of two selector plates, each supporting one detent, the plates being rotatable with respect to each other and then locked to rotate together. Rotation of a base plate forming another component of the detent allows complete flexibility for the user to choose their stance angle for snowboarding as well as the desired angle for skateboarding, and locking in the snowboarder's selected angle for automatic operation thereafter.

Specifically then, the present invention provides a binding rotation system for a snowboard having a base assembly attachable to the top of the snowboard at a location of a binding. A first selection plate rotates with respect to the base plate about an axis perpendicular to the top of the snowboard. A second selection plate rotates with respect to the base plate about the axis and is releasably attached to the first selection plate at a predetermined angle with respect to the first selection plate. A detent operates between the base assembly and the first selection plate to define a first rotative detent position and operates between the base plate and the second selection plate to define a second rotative detent position. The predetermined angle between the first and second selection plates determines the angular separation between the first and second detent positions.

Thus, it is an object of at least one embodiment of the invention to provide for the convenience of limited detent positions with the flexibility of adjusting the angle between detent positions desired by the user, so as to provide automatic positioning thereafter.

The detent may provide a manually operated release lever releasing an engagement of the detent, and the first rotative detent position may provide a soft-lock in which the first and second plates may be rotated relative to together in relation to the plate 38 by rotational pressure only on the binding by the user's foot. The second rotative detent position provides a hard-lock in which the first and second plates may be further rotated together only by activation of the lever of the detent.

It is thus another object of at least one embodiment of the invention to provide for the convenience of hard- and soft-locking in a device that allows the user the convenience of precise and automatic control of a desired stance angle, and alternately the skateboarding stance angle.

The detent may provide a spring pawl provided rotatively asymmetric disengagement forces producing hard-lock in one rotative direction, and soft-lock in another rotative direction. The first and second selection plates may include stops preventing rotation in different directions to produce the hard-lock and soft-lock.

Thus, it is another object of at least one embodiment of the invention to provide a simple method of implementing hard- and soft-locks in a system in which the detent positions may be readily changed.

The spring-loaded pawl may be inverted to change the rotative direction of the hard- and soft-locks.

Thus, it is another object of at least one embodiment of the invention to allow the binding to be used both in the "regular" and "goofy" stances, being positions in which the user faces different transverse directions during snowboarding.

The second selection plate may be releasably attachable to the first selection plate through interengaging rotatively periodic teeth providing a plurality of discrete predetermined angles.

Thus, it is another object of at least one embodiment of the invention to provide for a positive locking of the plates together without jeopardizing the ability to control relative angles.

At least one set of teeth may be radially disengagable.

It is thus another object of at least one embodiment of the invention to allow adjustment of the relative rotation of the plates with respect to each other when they are assembled and a person's foot is in the binding by preventing the need for axial separation of the plates.

A lock may lock radial disengagement of the teeth in engagement and may, for example, be a coin operable machine screw.

Thus, it is an object of at least one embodiment of the invention to allow for adjustment of stance angle without the benefit of a workshop or tools while on the slope.

A means for engaging or disengaging the radially disengagable teeth may be accessible when the binding rotation system is fully assembled with the user's foot in the binding.

Thus, it is another object of at least one embodiment of the invention to allow for both intuitive setting of the stance angle and for adjustment of the stance angle on the slopes.

A graduated scale may be on one of the first and second selection plates indicating the angular separation between the first and second detent positions.

Thus, it is another object of at least one embodiment of the invention to provide a method of reading and recording a desired selected stance angle to aid in adjustment and setting.

A connector may attach the base assembly to the top of the snowboard at a predetermined angle about the axis with respect to the connector.

Thus, it is another object of at least one embodiment of the invention to allow for simple angular adjustment of the base plate so that both the snowboarding stance and skateboarding stance may be independently adjustable.

The connector and base assembly may have rotatively periodic interengaging teeth providing a plurality of discrete predetermined angles between the base assembly and the connector.

Thus, it is an object of at least one embodiment of the invention to provide for robust attachment of the base assembly to the snowboard that nevertheless allows for a fine degree of rotative adjustment.

The rotatively periodic interengaging teeth may be axially disengaged by lifting the base assembly.

Thus, it is another object of at least one embodiment of the invention to allow for simple adjustment of the angle of the base assembly.

The second selection plate may be releasably attachable to the first selection plate at set ranges of predetermined angles with respect to the first selection plate. The first set of predetermined angles provides the first and second rotative detent positions, and the second set provides a third rotative detent position mirror symmetric with any first rotative detent position, and a fourth rotative detent position mirror symmetric with any second rotative detent position.

Thus, it is an object of at least one embodiment of the invention to allow a single binding rotational system to work for both "regular" and "goofy" users.

These particular objects and advantages may apply to only some embodiments falling within the claims and thus do not define the scope of the invention.

BRIEF DESCRIPTION OF THE DRAWINGS

FIG. 4 is a detailed plan view of a lower portion of the swivel connector of FIG. 3 as interlocks to a base plate;

FIG. 5 is a top plan view in fragment of the base plate of FIG. 3 with the stance-selector plate shown in phantom above it also showing regular and inverted "goofy" positionings of the detent pawl;

DETAILED DESCRIPTION OF THE PREFERRED EMBODIMENT

Figure 1:
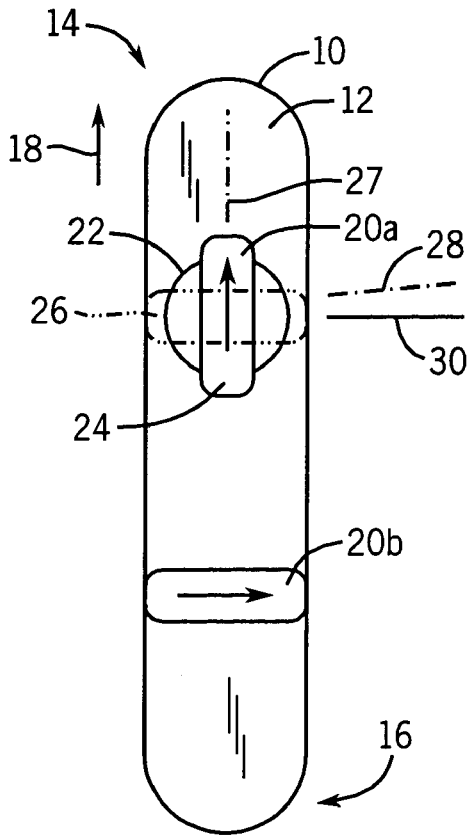
FIG. 1 is a top plan view of a snowboard showing regular mountings of the bindings, the front binding mounted on the system of the present invention and positioned for skateboarding.

Referring now to FIG. 1, a snowboard 10 has a top surface 12 extending between a nose 14 of the snowboard 10 and a tail 16 where a direction of normal travel 18 of the snowboard is in the direction of the nose 14.

Two bindings 20 may be attached to the top surface 12, a first binding 20*a* attached to the binding rotational system 22 of the present invention to swivel between a skateboarding orientation 24 shown in solid lines along skateboarding angle 27, and a regular snowboarding orientation 26 shown in dotted lines along snowboarding angle 28. In the skateboarding orientation 24, the front of the foot faces the nose 14, while in the snowboarding configuration, the front of the foot extends along a snowboarding angle 28 extending generally along a transverse axis 29. The rear binding 20*b* extends along the transverse axis 29 at a fixed stance angle according to conventional technique.

Figure 2:
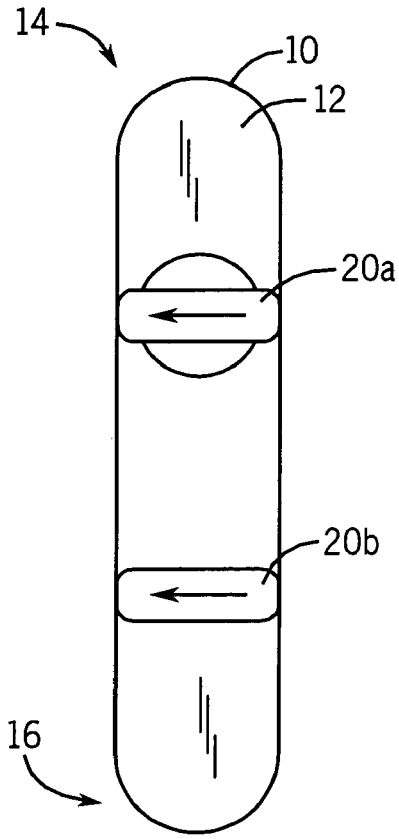
FIG. 2 is a figure similar to that of FIG. 1 showing both bindings positioned for snowboarding in the "goofy" orientation.

Referring to FIG. 2, a snowboard 10 may also be used in so-called "goofy" mode in which the front of the bindings 20*a* and 20*b* and hence the foot orientation extends along the transverse axis 29 to the left as viewed in FIG. 2 rather than the right as viewed in FIG. 1. The present invention provides swivel mounting for both regular and goofy stances.

Figure 3:
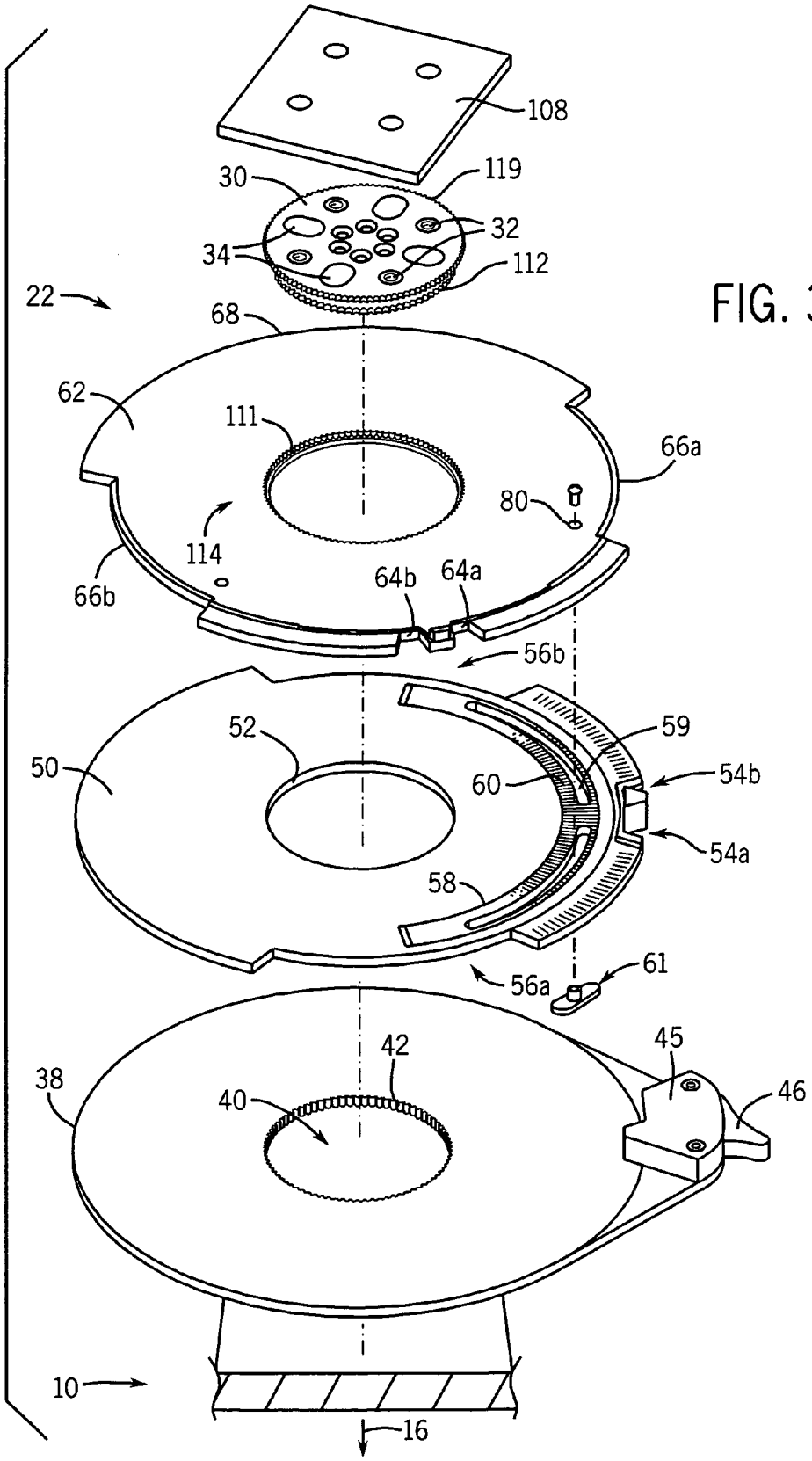
FIG. 3 is a perspective, exploded view of the principle components of the binding rotational system of FIGS. 1 and 2 as mounted above the surface of the snowboard.

Referring now to FIG. 3, the binding rotational system 22 of the present invention provides a swivel connector 30 that may be attached to the top surface 12 of the snowboard 10 and that provides an upper swivel section and lower swivel section that freely rotate with respect to each other about a vertical axis perpendicular to the top surface 12 of the snowboard 10. Radially outwardly extending teeth 112 on the upper swivel section of the swivel connector 30 are received by corresponding radially inwardly extending teeth 42 of a central bore 40 of a base plate 38 so as to lock the two together preventing rotation or lifting of the base plate 38 when the swivel connector 30 is attached to the snowboard 10. Radially outwardly extending teeth 119 on the upper swivel section of the swivel connector 30 are received by corresponding inwardly extending teeth in a central bore 114 in the upper surface of a skateboard plate 62. The root of the teeth 119 also engage a lip 111 of a bore 114 in the upper surface of the skateboard plate 62 retaining the skateboard plate 62 toward the snowboard 10 when the swivel connector 30 is attached to the snowboard 10.

The top of the swivel connector 30 includes four threaded holes 32 for attaching a binding 108 (shown in fragment) to the top of the swivel connector 30 and four access holes 34 providing access to series of recessed mounting holes 36*a* and 36*b* to be described below, that are used (with bolts) to attach the swivel connector 30 to the snow snowboard 10.

Referring momentarily to FIG. 4, the recessed mounting holes 36*a* and 36*b* together provide standard bolt hole patterns 31 for different snowboards 10 having different threaded hole spacing patterns. Recessed holes 36*a* allow use of either a four bolt patterns or use of three hole patterns found in the base simply by rotating the upper swivel portion of the swivel connector 30 so as to expose the desired bolt hole pattern The base plate 38 is a circular disk approximately nine and a quarter inches in diameter with a single lateral protrusion for mounting the lock 45 on vertical mounting pegs, rising from the eighth of an inch high base. As noted above, the base plate 38 includes a central bore 40 having inwardly extending teeth 42 sized to engage the outwardly extending teeth of the tooth portion 112 so as to lock the base plate 38 to the top surface 12 of the snowboard together as a single fixed unit. The lock 45 has a lock lever 46 is attached to the periphery of the base plate 38 as will be described below.

Referring again to FIG. 4, the interengagement of teeth 42 and teeth 112 allow the base plate 38 to be positioned at a variety of rotational angles with respect to the lower portion of the swivel connector 20. Because the base plate 38 is immovably mounted on the snowboard it controls the location of the lock 45. As will be described, this fixed position allows a stance selector plates 50 and skate plate 62 to rotate their respective notches 54 and 64 into a lock position with pawl 86 to achieve a hard-lock position of the snowboarding stance angle 28 as will be understood from the description below.

Stance-selector plate 50 is of comparable dimensions to base plate 38, but includes regular and goofy hard-lock notches 54*a* and 54*b* and wider regular and goofy clearance notches 56*a* and 56*b*, the latter centered approximately forty-five degrees from corresponding notches 54*a* and 54*b*. Each of these notches 54 is in the periphery of the stance-selector plate 50.

Generally, one of notches 54*a* and 54*b* may engage with the lock 45 to define the hard-lock angular position of stance-selector plate 50 with respect to base plate 38 for the snowboarding stance angle 28.

As shown in FIG. 3, a partial ring gear 58 extends from the upper surface of the stance-selector plate 50 having upwardly extending teeth 60. Slots 59 extending through the partial ring gear 58 allow a t-nut 61 to slide along the slots 59, the t-nut 61 fitting below the stance-selector plate 50 and exposing a threaded nut opening through the slot 59 accessible from above the stance-selector plate 50.

Referring now to FIGS. 3 and 5, a skateboard plate 62 has dimensions similar to that of base plate 38 and stance-selector plate 50, but includes soft-lock goofy notches 64*b* and soft lock regular notches 64*a* flanked by clearance notches 66*a* and 66*b*, each comparably spaced to the notches 54 and 56 on ride stance-selector plate 50. Skateboard plate 62 likewise has a central bore 68 fitting about a cylindrical axle portion of the swivel connector 30 to turn co-axially with the swivel connector 30.

As shown in FIG. 5, the undersurface of the skateboard plate 62 has a partial ring gear 70 having downwardly extending teeth 72 that may engage the upwardly extending teeth 60 of the ring gear 58 when skateboard plate 62 is placed on top of Ride stance-selector plate 50. The interengagement of teeth 60 and 72 allow the relative positions of stance-selector plate 50 and skateboard plate 62 to be locked in any of a variety of rotative positions to rotate jointly with the upper portion of the swivel connector 30.

The relative positions of stance-selector plate 50 and skateboard plate 62 define the separation between the soft lock notches 64 and the hard lock notches 54 (for either regular or goofy stance), and thus allow adjustment of the separation of the snowboarding and skating stance angles. One of the notches 66 in the stance-selector plate 50 overlaps a notch 54 so as to prevent interference of notch 54 by the skateboard plate 62, and likewise one of the notches 56 in the stance-selector plate 50 overlaps a notch 64 in the skateboard plate 62 so as to prevent interference of notch 64 by the stance-selector plate 50.

The particular angle of relative rotation between stance-selector plate 50 and skateboard plate 62 may be read off of a scale 74 printed on a flange 76 between notches 54 and 56 of the stance-selector plate 50 where it is exposed at one edge of notch 66*a* or 66*b*.

Ring gear 70 may flex upward slightly to disengage with ring gear 58 allowing easy adjustment of the relative positioning of the stance-selector plate 50 and skateboard plate 62. The ring gear 70 may then be engaged with ring gear 58 by tightening an adjustment screw 80 exposed at the top of the skateboard plate 62 and visible in FIG. 3. The adjustment screw 80 fits through slot 59 in the stance-selector plate 50 to engage the t-nut 61. The screw 80 is accessible even when the binding is in place to allow simple adjustment on the slope or the like through a coin which will engage with the slot of screw 80.

Referring still to FIG. 5, the lock 45 provides a lever 46 attached to a pawl 86 which may engage notches 54*a* or 64*a* (e.g., for regular stance) to cause the co-rotation of the stance-selector plate 50 and skateboard plate 62 to stop at those positions as the pawl 86 engages those notches 54*a* or 64*a*. The pawl 86 is spring loaded by spring 88 and pivots about an offset pivot 90 so that the pawl 86 is self-disengaging with clockwise rotation 92 of the notches 54*a* or 64*a*, but self-engaging with counterclockwise rotation 94 of the notches 54*a* or 64*a*. That is, sufficient force in a clockwise direction (absent the stops to be described) will cause the pawl 86 to rise up a slope side of the notches 54 or 64*a* to disengage from them by compressing the spring 88 and rotating about the pivot 90 whereas with counterclockwise rotation, the forces are such as to further engage the pawl 86 with the notch 54*a* or 64*a*.

A hard stop at notch 54*a* is provided by providing a mechanical stop 100 extending upward between notches 54*a* and 54*b* that prevents further clockwise rotation when the pawl 86 is engaged with notch 54*a* despite the natural self-disengaging mode of the lever 46. Similarly, a stop 102 is placed between notches 64*a* and 64*b*. The pawl 86 may be a split pawl, one level engaging the stance-selector plate 50 and the other engaging the skateboard plate 62 and having a stop engaging, non-retractable member positioned therebetween the levels to engage the stops 100 and 102. Accordingly hard stop or soft stop locations may be created at selected of the notches 54*a* and 64*b* with notch 54*a* providing a hard stop and notch 64*a* providing a soft stop.

A hard stop means that the pawl cannot be disengaged from the hard stop at notch 54*a* without manual movement of the lever 46, whereas when the pawl is engaged with the soft stop location of notch 64*a* sufficient force in torque is on the stance-selector plate 50, and skateboard plate 62 will disengage the pawl from the notch allowing the plates to freely move with the swivel connector 30.

It will be understood that relative rotation of the skateboard plate 62 with respect to the stance-selector plate 50 allows adjustment of the separation distance in angle 106 between hard stop and soft stop locations, and thus the ability to move the base plate 38 together with the ability to adjust the relative positioning of the stance-selector plate 50 with respect to the skateboard plate 62, allows complete freedom of adjustment of both the hard- and soft-lock positions of snowboarding and skateboarding at angles 28 and 27 per FIG. 1.

Referring again to FIG. 3, the upper surface of the skateboard plate 62 may have the binding 108 (shown in fragment) that may be attached to the swivel connector 30 to retain the two together against the top surface 12 of the snowboard 10 with the plates 38, 50 and 62 captured there between. The attachment is such as to allow free movement of the stance-selector plate 50 and skateboard plate 62 when released from the lock 45.

Figure 6:
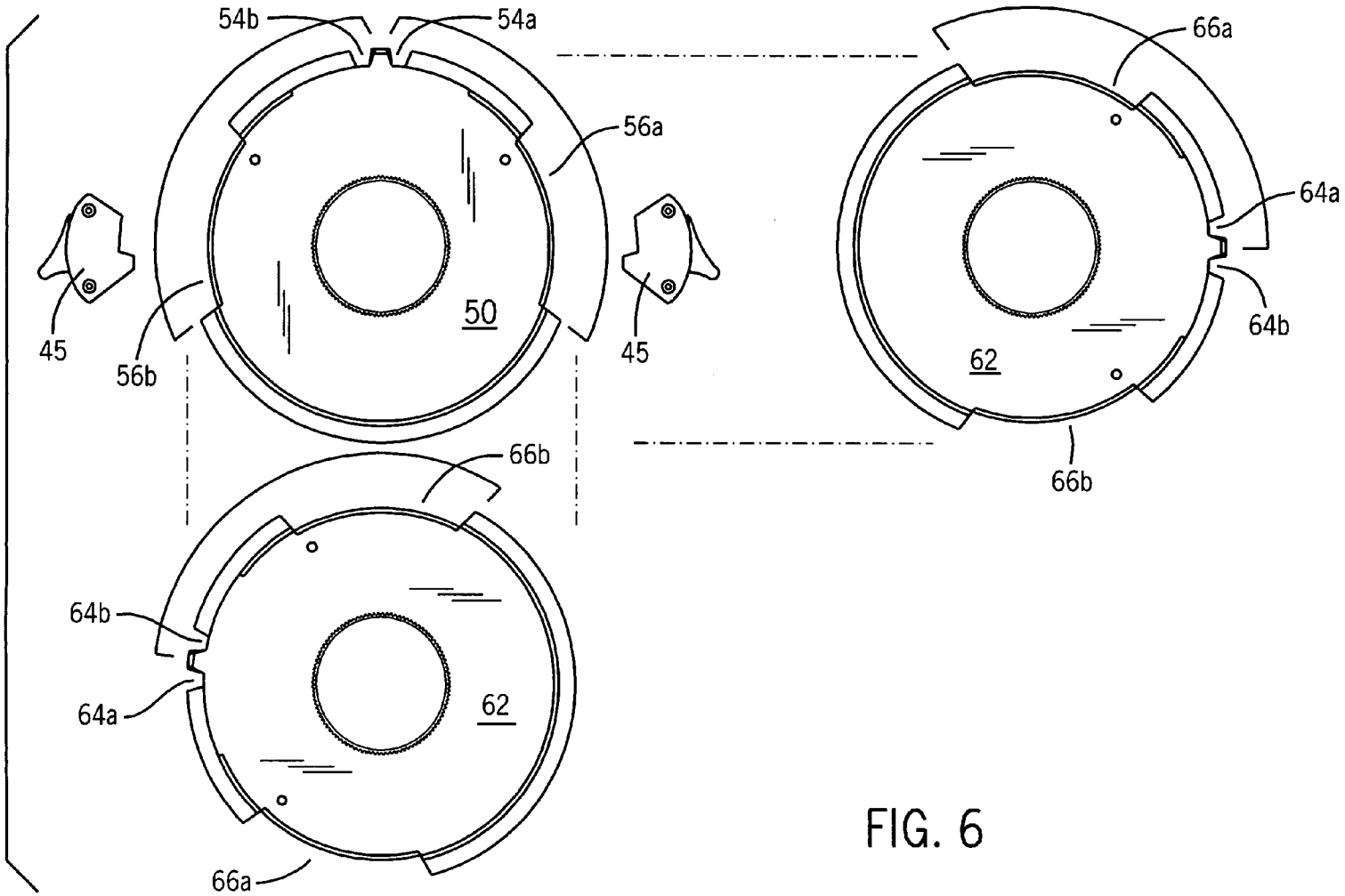
FIG. 6 is a plan view of the base plate and the stance-selector plate in two different configurations allowing for "regular" and "goofy" use.

Referring now to FIG. 6, the present invention provides for symmetry of stance-selector plate 50 and skateboard plate 62 with mirror symmetric notches 54*b* and 56*b* serving for the goofy stance on stance-selector plate 50 and mirror symmetric notches 54*a* and 56*a* serving for regular stance. A first orientation of skateboard plate 62 with notch 64*a* to the right and notch 66*a* to the top, provide for the combination of the detent positions for regular stance whereas when the notches 64*b* and 64*b* are positioned to the left and top, respectively, detents are provided for goofy stance.

Referring also to FIG. 5, the lever 46, spring 88, and pivot 90 as held in a cartridge held within the lock 45 may be flipped to positions shown in FIG. 4 as lever 46', spring 88', and pivot 90' as to provide for a goofy lock 45 shown in FIG. 6 or a regular lock 45 also shown in FIG. 6 reversing the hard and lock functions with respect to rotational directions as is required.

It is specifically intended that the present invention not be limited to the embodiments and illustrations contained herein, but include modified forms of those embodiments including portions of the embodiments and combinations of elements of different embodiments as come within the scope of the following claims.

I claim:

1. A binding rotation system for a snowboard comprising:

a base assembly attachable to a top of the snowboard at a location of a binding;

a first selection plate rotating with respect to the base plate about an axis perpendicular to the top of the snowboard;

a second selection plate rotating with respect to the base plate about the axis, the second selection plate releasably attachable to the first selection plate at a predetermined angle with respect to the first selection plate;

a detent operating between the base assembly and the first selection plate to define a first rotative detent position and operating between the base assembly and the second selection plate to define a second rotative detent position; and a binding attached to at least one of the first and second selection plates;

wherein the predetermined angle determines an angular separation between the first and second detent positions.

2. The binding rotation system of claim 1 wherein the detent provides a manually operated release lever releasing an engagement of the detent; and wherein the first rotative detent position provides a soft-lock in which the base plate and the first selection plate may be further rotated relative to each other by pressure only on the binding by a user's foot; and wherein the second rotative detent position provides a hard-lock in which the base plate and the second selection plate may be further rotated relative to each other only by activation of the lever of the detent.

3. The binding rotation system of claim 2 wherein said detent provides a spring-loaded pawl providing rotatively asymmetric disengagement forces producing hard-lock in one rotative direction and soft-lock in an other rotative direction; and wherein the first and second selection plates include stops preventing rotation in different directions to produce the hard-lock and soft-lock.

4. The binding rotation system of claim 2 wherein the spring-loaded pawl may be inverted to change a rotative direction of the hard- and soft-locks.

5. The binding rotation system of claim 1 wherein the second selection plate is releasably attachable to the first selection plate at a predetermined angle with respect to the first selection plate through interengaging rotatively periodic teeth providing a plurality of discrete predetermined angles.

6. The binding rotation system of claim 5 wherein at least one set of teeth are vertically disengagable.

7. The binding rotation system of claim 6 including a lock locking the vertically disengagable teeth in engagement.

8. The binding rotation system of claim 7 wherein the lock is a operable without special tools.

9. The binding rotation system of claim 6 including means for engaging and disengaging the vertically disengagable teeth when the binding rotation system is fully assembled with a user's foot in the binding.

10. The binding rotation system of claim 1 including a graduated scale on at least one of the first and second selection plates indicating the angular separation between the first and second detent positions.

11. The binding rotation system of claim 1 further including a connector attaching the base assembly to the top of the snowboard at a predetermined angle about the axis with respect to the connector;

whereby the angle of the base assembly on the snowboard may be adjusted to control the angle of the detent position by adjusting the predetermined angle between the base assembly and the connector.

12. The binding rotation system of claim 11 wherein the connector and base assembly have rotatively periodic interengaging teeth to provide a plurality of discrete predetermined angles between the base assembly and the connector.

13. The binding rotation system of claim 11 wherein the connector provides a hole pattern for mounting the connector to the snowboard accommodating three and four hole mounting patterns on the snowboard.

14. The binding rotation system of claim 1 wherein a lever is attached to the base plate.

15. The binding rotation system of claim 1 wherein the second selection plate is releasably attachable to the first selection plate at two sets of predetermined angles with respect to the first selection plate, the first set of predetermined angles providing the first and second rotative detent positions, and the second set of predetermined angles provides a third rotative detent position mirror symmetric with the first rotative detent position, and a fourth rotative detent position mirror symmetric with the second relative detent position.

* * * * *